United States Patent [19]

Sutter

[11] 4,112,485

[45] Sep. 5, 1978

[54] IMPACT RESISTANT EXPLOSION PROOF LAMP COMPRISING ENCAPSULATED LIGHT SOURCE

[76] Inventor: Aldo Sutter, im Berghof 1, 8700 Kusnacht, Switzerland

[21] Appl. No.: 682,754

[22] Filed: May 3, 1976

[30] Foreign Application Priority Data

May 9, 1975 [CH] Switzerland ..... 5940/75

[51] Int. Cl.[2] ..... F21V 15/04

[52] U.S. Cl. ..... 362/369; 313/110; 313/312; 362/377; 362/390

[58] Field of Search ..... 240/11.2 E, 48, 90, 240/58, 51.11; 313/324, 110, 111, 116, 312; 362/369, 376, 377, 390

[56] References Cited

U.S. PATENT DOCUMENTS

| | | | |
|---|---|---|---|
| 3,002,122 | 9/1961 | Unger | 313/312 |
| 3,087,982 | 4/1963 | Hayes | 313/312 |
| 3,136,489 | 6/1964 | Oharenko | 240/51.11 |
| 3,808,495 | 4/1974 | Win | 313/110 |

FOREIGN PATENT DOCUMENTS

| | | | |
|---|---|---|---|
| 559,369 | 6/1958 | Canada | 313/324 |
| D15,287 | 10/1956 | Fed. Rep. of Germany | 240/11.2 E |

OTHER PUBLICATIONS

IBM Technical Disclosure Bulletin, vol. 7, No. 5, Oct. 1964.

*Primary Examiner*—Monroe H. Hayes
*Attorney, Agent, or Firm*—James E. Nilles

[57] ABSTRACT

A lamp comprises one or more light sources encapsulated as by casting in an inner relatively soft impact absorbing transparent material, such as polymerized silicone rubber, and in an outer relatively hard impact resistant transparent material, such as acrylic or glass. The lamp which may be used alone, or in combination with other protective housing components for specialized purposes, such as runway or highway lighting, is impact resistant, pressure resistant, completely sealed, waterproof, electrically insulated, and explosion proof.

18 Claims, 7 Drawing Figures

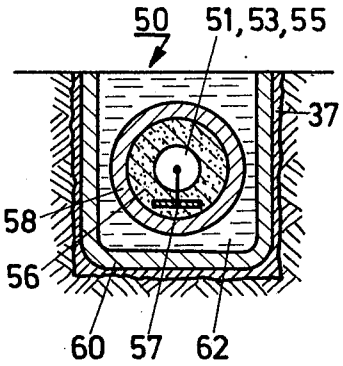
FIG. 4
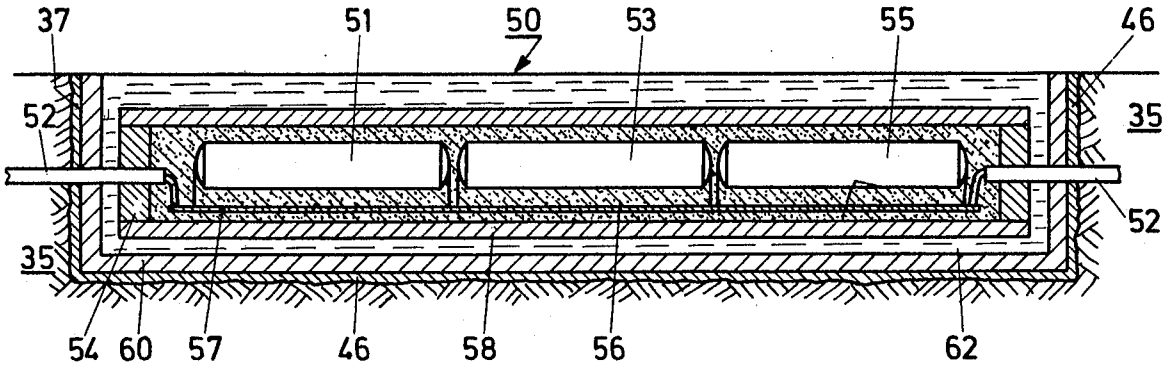
FIG. 3
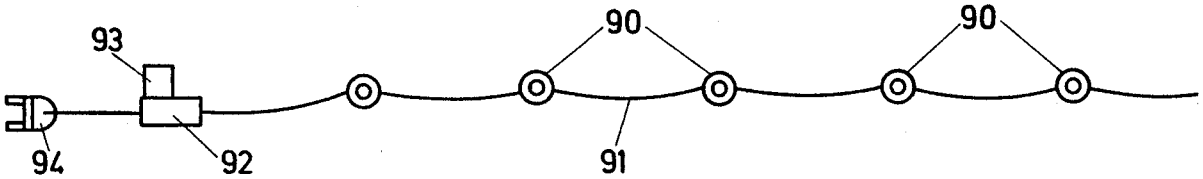
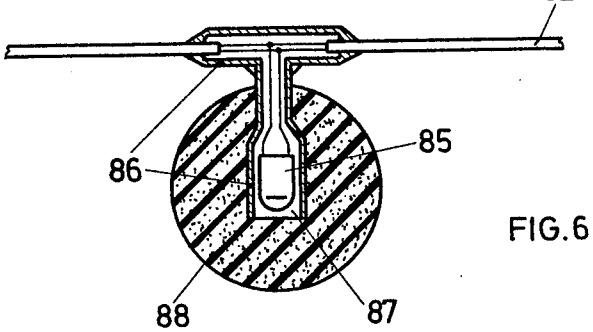
FIG. 6
FIG. 7
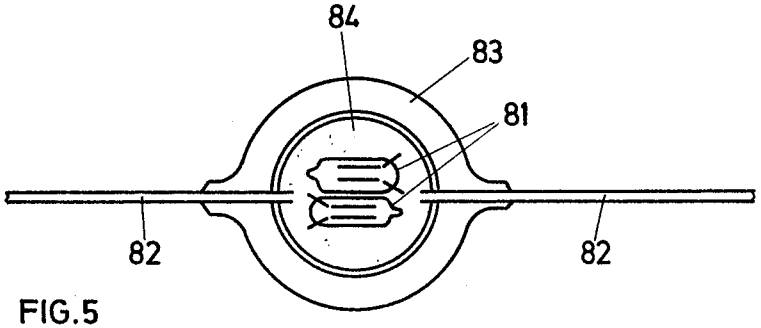
FIG. 5

IMPACT RESISTANT EXPLOSION PROOF LAMP COMPRISING ENCAPSULATED LIGHT SOURCE

BACKGROUND OF THE INVENTION

1. Field of Use

This invention generally relates to impact resistant explosion proof lamps comprising enclosed or encapsulated light sources. In particular, it relates to such lamps wherein one or more light sources are encapsulated as by casting in several layers of transparent materials which have different elasticities.

2. Description of the Prior Art

Electric lamps are known in which a light source is placed into a transparent casing and tightly enclosed therein (see German Patent DGM No. 1,833,690). In other versions, one or several light sources are directly and tightly surrounded with transparent cast polyester or similar material and designated as "explosion-proof" (see British Pat. No. 1,166,442 and U.S. Pat. No. 3,310,670).

The latest technology further includes electric lighting devices for the marking of airplane landing strips with a trough-type housing submerged in the runway surface, which is covered by a transparent plate or a slotted cover plate, and in which housings light sources are mounted which can be switched on and off from the outside (see CH-PS 355 360).

SUMMARY OF THE PRESENT INVENTION

The purpose of the present invention is to provide a lamp of the aforesaid type which is shock-absorbing and explosion-proof.

This purpose is met by this invention, which is characterized by the fact that the casing is constructed in several layers into an impact-, pressure- and explosion-proof unit, and that the lamp constitutes a non-dismountable whole.

This results not only in completely tight encapsulation, electrical insulation, and water-tightness (which also leads to tightness against dust and other aggressive fluid media), but also in increased thermal capacity and very high resistance to extreme external mechanical stresses such as pressure, pressure waves, vibrations, hard impacts, projectiles and fragments from explosions. The principle of a hard-soft-hard casing, with suitable geometric configuration, offers maximum damping and reflection of external kinetic stresses on the lamp and consequently maximum protection against breakage of the hollow glass cover of the cast-surrounded electric light sources. The alternately softer and harder casing layers have differing density and elasticity.

The multi-layer construction of the lamp described herein not only guarantees high abrasion-resistance — which is important for the insertion of such light units in the surface of driving lanes and runways for marking purposes — but also effective impact- and explosion-proofing of these lamps. As shown by stress-testing, this cannot be achieved in the above-mentioned lamps with light sources surrounded by only one hard casing.

These light sources are characterized by very great longevity and less or minimum absorbtion capacity.

Because of the required tight encapsulation, very light-intensive filament lamps cannot be used (thermal stress). Furthermore, they generally have a short service life.

Subsequently, several diagrams will be used as examples in order to explain the invention.

BRIEF DESCRIPTION OF THE DRAWINGS

FIG. 3 is a longitudinal cross section of a third embodiment of a lamp analogous to that shown in FIG. 2, but cylindrical construction, and with external U-profile reinforcement;

FIG. 4 is a transverse cross section of the lamp shown in FIG. 3;

FIG. 5 is a cross section of a fourth embodiment in the form of a spherical lamp with two glow units;

FIG. 6 is a cross section of a fifth embodiment in the form of a spherical lamp with a small filament bulb; and FIG. 7 is a schematic view showing a chain of lamps of the type shown in FIGS. 5 and 6.

DESCRIPTION OF A PREFERRED EMBODIMENT

Figure 1:
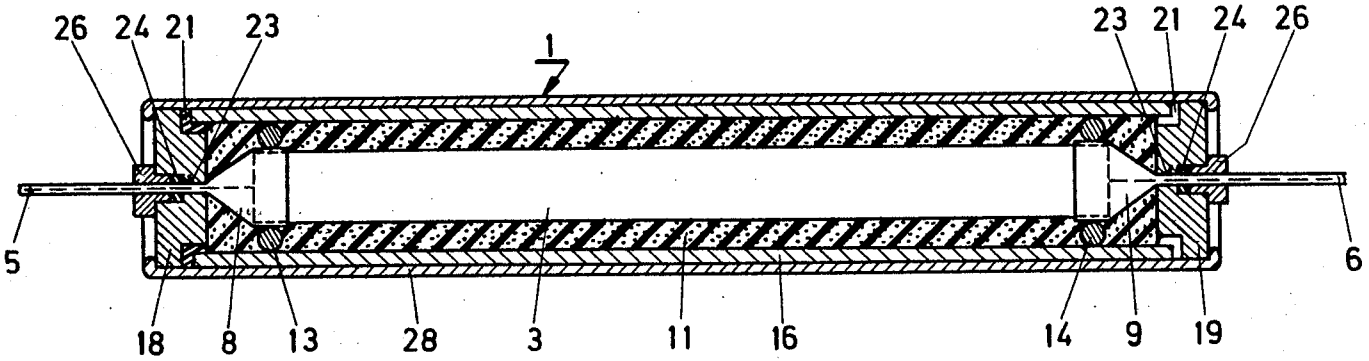
FIG. 1 is a longitudinal cross section view of one embodiment of a cylindrical lamp in accordance with the invention.

The lamp 1 shown in FIG. 1 has as its light source a neon tube 3, at the ends of which one each of an electric cable 5 and 6 is connected. These connections can also be made only on one side of the lamp. The electrical connections are sealed off and electrically insulated by means of a hard putty 8 and 9. The neon tube 3 is surrounded by a cylindrical, thick-walled casing in the form of a pipe, which consists preferably of transparent acrylic glass or polycarbonate and gives the lamp 1 rigidity and impact resistance. The neon tube 3 is centered in the protective casing 16 by means of support rings 13 and 14 at the end caps of the neon tube.

One each of a cover 18 and 19 is located at both ends of the protective casing 16. These covers may consist of the same material as the protective casing 16. They are firmly and tightly connected with the protective casing 16 by means of a putty material 21, such as acrylic resin putty. The covers 18 and 19 have been provided with suitable conduits 23 for the connecting cables 5 and 6. In addition, the cables leading through the cover are insulated and sealed to the outside with O-rings and clips.

The space between the neon light 3 and the protective casing 16, including covers 18 and 19, is filled with a transparent, elastomer soft material 11, preferably of polymerized silicone rubber, which completely seals off the neon tube and functions as a second electrical insulation to the outside. This filling material serves mainly to absorb impact impulses and to dampen vibrations. Further, the protective casing 16 can be provided with an external, impact-absorbing elastomer protective layer 28, which is cast on, laid on or applied by thermal shrinking.

A lamp of this type constitutes a non-dismountable whole, a monoblock.

Such a lamp, which could be battery-fed with the battery tightly enclosed in the lamp, is also used for medical applications, provided that it can be sterilized. For this purpose the outermost layer of the lamp could consist of a coating which is stable under sterilizing temperatures, i.e., a polycarbonate, especially Teflon. This type of coating would also render the lamp chemically inert.

Figure 2:
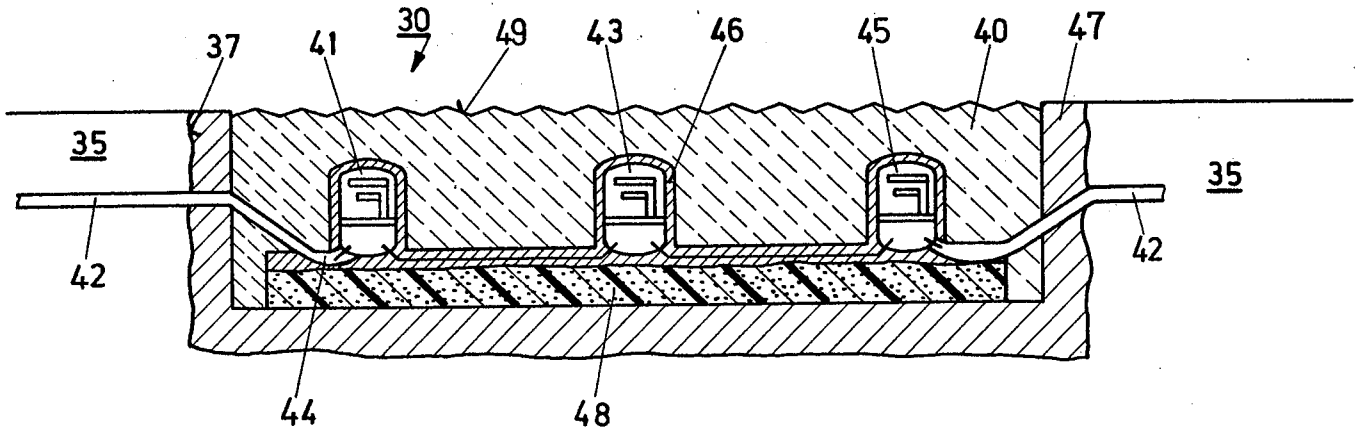
FIG. 2 is a longitudinal cross section of a second embodiment of a lamp in accordance with the invention mounted in the ground, such as runway or road surface.

FIG. 2 shows a different version of a lamp which, for instance, is intended for insertion in the surfacing of streets, highways, or runways. A hole 37 is cut into the surface and a lamp 30 with rectangular cross section is inserted. In this lamp there are three, but at least two, neon lights 41, 43 and 45, inserted side by side in a transparent housing, preferably acrylic glass or polycarbonate, which are surrounded by a transparent, elastomer cast 46, preferably silicone rubber. In addition to electric insulation the cast material must also have suitable optical characteristics. The groove located in the bottom of the lamp 30 is filled and tightly sealed with hard putty 48, preferably poly-epoxy-resin. The drawing further shows an electric feed cable 42, which is anchored and insulated in the lamp by means of a putty 44.

The lamp has an outer surface 49, which may be beaded, grooved or facetted to achieve the desired optical effect.

The lamp 30 is fastened into the cut-out 37 of the runway-surface 35 by means of fastening putty 47.

FIGS. 3 and 4 show a lamp 50 in longitudinal and cross section, with a construction similar to the lamps shown in FIGS. 1 and 2. Three longitudinal luminous lamps with reflector cathodes 51, 53 and 55 are mounted in a transparent protective tube 58. The luminous lamps and their rheostats, as well as the feed cables 52 are directly connected to the printed circuit card 57 by means of soldered spots. The light sources 51, 53 and 55 inside the protective tube 58 are completely cast into an elastomer, transparent filling material 56. The protective casing 58 is tightly sealed with a hard putty on both sides. This lamp is placed into a U-profile 60, preferably hard PVC, iron, aluminum alloy or similar material, and completely surrounded by a transparent cast material of hard polymerized resin 62, preferably epoxy, polyester, methylmetacrylate, etc. The lamp can now be placed into the groove or hole 37 of the runway surface 35 and anchored flush with the surface by means of a hard putty 46 and/or mounting screws.

As a result of the small surface area of the lamp 50, compared with the bearing surface of the tires of vehicles or planes moving on the runway 35, and because of the additional reinforcement by a thick U-profile 60 in road surfaces, such lamps can achieve very high pressure and expansion load capacity. The elastomer casing of the light sources can absorb high impact impulses without breakage of the luminous lamps or neon tubes imbedded therein.

It is also possible to pre-mount the U-profile 60 in the hole 37 in the road surface 35, and the lamp can subsequently be anchored into the U-profile with putty. The feed cables 52 are placed in a small groove, which was cut into the road surface for this purpose, and after installation of the complete lamp chain the grooves are filled flush with the surface with putty, tar or flintcote.

The power feed of such a long lamp chain, as it would be used, for example, to mark a highway centerline, is accomplished either continuously from lamp to lamp, or by means of a trunk line with short branches for each lamp. Light-markers for highways would have to be fed and secured in blocks of, i.e., 2–5 km. The main power would run parallel with the road or through tap lines running from closely placed sources to the lane.

By using a balanced redundancy one can considerably increase the operating safety and longevity of such light markings. For example, the lamps no. 1, 4, 7, etc., no. 2, 5, 8, etc., and no. 3, 6, 9, etc., of a lamp chain will be fed by three independent sources, respectively. Furthermore, the light sources within a lighting unit can also be divided and fed in two or more independent groups, so that it becomes impossible for the light markings to fail at all, or to fail over great distances. These various wiring possibilities can be incorporated in the design of the trunk line or the feeder lines. In addition, it is possible to wire the light markings for blinking, for the whole distance, partial distances or within the individual lighting unit.

FIG. 5 shows a small spherical lamp with a continuous feed cable 82 and two luminous lamps 81 as light sources. These latter are tightly surrounded by a cast transparent, elastomer material 84. Around this inner casing 84 an outer, sphere-shaped protective casing 83 of colored, transparent or light-diffusing plastic is pressed, sintered or cast-filled with a hard-polymerized resin.

FIG. 6 shows another variation of a spherical lamp with a feed cable 82 and a miniature filament bulb 85 as light source. This latter bulb 85 is placed in a casing tube 86 of plexiglass, transparent PVC, etc., and connected to the electric power cable 82. The complete casing tube 86, including filament bulb 85 and a portion of cable 82, is surrounded with a transparent and hard material such as polyester or acrylic resin. Around this inner casing an outer spherical casing of dyed silicone rubber 88 is cast.

These small lamps can be practically destroyed only deliberately or in accidents. They can be series-connected by means of a tension-reinforced feed cable to form very handy lamp chains, as shown in FIG. 7. The power supply would come from a circuit plug 94 via a transformer 92 for the desired operating voltage, i.e., 2–12 V and a blinker 93. The lamps can also be fed from an accumulator or battery. This lamp chain can be rolled up or reeled and offers a welcome and simple method for the marking of barriers, warning signs, danger signs, "no entry" signs, etc.

The hydrostatic load capacity of the above lamp is greater than 100 atu, particularly since hard, cylindrical casings, which could consist of polycarbonate, can be additionally reinforced under pre-tension with longitudinally and annularly placed glass fiber strands. The permissible temperature range for the operation of these lamps can be extended from $-80°$ to $+130°$ C.

The individual light units can also be used as lamp chains, or they can be arranged together in almost any configuration in lines, surfaces and clusters, which are then given an additional outer shield of a hard polymerizing material.

The following light sources can be used:
small filament lamps
gas discharge lamps with/without fluorescence
glow lamps with/without fluorescence
intermetal light diodes
UV black glass lights with fluorescent material.

The internally closed body of the lamp is transparent on all sides, or at least on one side. The electric power feed is either built into the lamp body or accomplished by at least one external connection. The lamp does not need any additional cooling, can be operated in any position continuously, blinking or flashing, and can be constructed in almost any exterior shape and color.

In conclusion, the following should be remembered.

The light unit or lamp comprises:

1. the electrical light sources (glow lamps, gas discharge lamps, in particular flash lamps, filament lamps, intermetal light diodes, UV black glass lamps);

2. the body of the light unit, consisting of several successively constructed layers or masses with alternately harder and softer mechanical characteristics, in which the light sources and cables are completely surrounded by cast insulating, sealing, and impact resistant material, which is also transparent; and 3. the connecting or feed cable, which feeds electric power to the individual lamps or the chain, possibly with a variety of switching plans.

A series of light units forms the light marking chain. The distance between the lights, the size of light units, type and shape of the lamp, lamp color, light intensity and choice of light source depend on the intended use.

This lamp is characterized as follows:

(a) It is completely enclosed in itself, i.e., the light units are electrically insulated, gas, water and dust-tight, tight against mineral oils and derivatives, diluted hydrochloric acid and other media. The light units are impact and pressure-resistant, as well as explosion-resistant; these latter characteristics can be adapted to the existing requirements. The light units are extremely abrasion-resistant. This feature is considerably improved by the fact that their dimensions can be kept so small that they are protected against abrasion largely by the surrounding material (i.e., road covering).

(b) It is a self-illuminating and does not rely on the reflection of the light from vehicle lamps. Therefore, it can be used deliberately and at the proper time as markings. The distance at which such markings can be optically perceived, especially in traffic ground marking, is considerably greater than with any type of reflection of the lamp light of moving vehicles.

(c) It has a level of electric energy consumption so low (i.e., about 100–200 Watts per highway km) that it affects the operating costs only negligibly.

(d) The color of the light markings may be chosen freely and especially for maximum contrast for the intended use.

(e) Several color combinations and codes are possible by means of suitable wiring, and that it can be wired for blinking or flashing.

(f) The shape of the light markings built into the road surface may be chosen freely (i.e., arrows, letters, etc.).

(g) It can be used in any position, without cooling, for the most varying applications.

(h) It has a long longevity or operating life, causes only minimal maintenance expenses and is also extremely aging-proof.

(i) Commercial materials can largely be used for the construction (and commercially available components).

(j) It can be mass-produced at very low production costs.

(k) It can be imbedded in ice and be used in various liquid media or under water.

(l) It can be arranged in whole chain lines or areas for special lighting applications.

(m) It can be used as an effectively explosion-proof and gas-tight lighting unit.

The body, or the hard protective casing of the light unit is cast, molded, extruded or machined from one block of material. The material can be acrylic resin or glass (polymethylmetaacrylate), polycarbonate (PC) cast polyepoxy and polyester resins, hard PVC or similar plastics. These must be transparent, have resistance against various solvents and acids, mechanically stable in a heat range of at least −25° to 80°/100° C., non-flammable or fire retarding or self-extinguishing, and have high electric insulation.

Depending on the required mechanical stress capacity the body will be constructed from a greater or smaller number of layers or covers with differing elasticity modules, so that maximum absorbtion and damping of impact impulses, or mechanical deformation of the lamp body, is achieved and thus the maximum protection of the glass cover of the light source is obtained. The construction constitutes a compromise between high mechanical rigidity and stress capacity in the outer protective casing and high absorbtion of local, mechanical variable stresses in the intermediate layer, which is cast of transparent elastomer. The lamps mounted flush with the surface of the runway must meet the following tightness requirements:

1. watertight (rain, ice and snow melt),
2. dust and mudtight,
3. high electrical insulation,
4. resistance to gasoline, kerosene, mineral oils, tar,
5. resistance to diluted hydrochloric acid (winter salting).

The optical characteristics must not be essentially affected by UV (ultraviolet) sun radiation.

The light intensity of such marker lights is sufficient to assure optical recognition up to about 1,000 m, especially on highways. The required electric power for the individual light markers is extremely low. The determination of line should be emphasized by geometric arrangement or cadence of the individual lamps, as well as by suitable contrasting light color.

Such lamps have the following applications.

1. They can be used as a rod or space light: in laboratories, work shops, rooms where danger of explosion exists, in industry, in machine construction, in mining, in the general and petroleum chemical industry, for military installations, for clinical purposes. They can be used as a submerged light for docks, port facilities, ship building yards, tank inspections, chemotechnical processes, frozen in ice, for life saving operations. They can be used for application in the chemical industry as submerged light in various chemically active liquids and at extreme temperatures, i.e., light inspection of filled containers, silos and tanks, such as heating oil and many others. They can be used for applications in medicine such as clinical sterilization and physiological compatibility of the lamp. They can be used for applications in atom technology, such as underwater lighting of basins and inspection of atomic installations. In case of radioactive contamination the lamp can be chemically decontaminated without damage.

2. They can be used as a lamp chain for barriers, detours, danger signs, in construction and industry, by police, fire brigades and the military, for the airway lighting of cross-country high tension cables, cable car cables, flight hazards as a mobile and windable runway lighting. They can be used as submerged or floating underwater light marking or as a 'flexible' long lamp chain for the lighting or inspection of canals and pipelines (around curves).

3. They can be mounted into the ground flush with the road surfacing as light markers for street or road traffic, as a centerline or safety line, for stops, pedestrian markers, traffic signals (letters, symbols, arrows). They can be used as traffic guide markers, marking of danger zones and barriers in industrial installations and in the atomic industry. They can be used for the marking of runway-approaches and parking positions of airports, for marking the bottom of swimming pools, for helicopter pads on buildings and marine oil drilling towers, for military purposes, or on the decks of aircraft carriers.

I claim:

1. A fluid-tight self-cooling impact-resistant electric lamp comprising: a light source, and a multilayered casing having a translucent region and in which said light source is entirely embedded, said casing completely enveloping and in contact with said light source in sealed relationship for inhibiting transmission of shock forces to said light source, said multilayered casing comprising at least two layers of material, namely, an inner layer of material and an outer layer of material, with one layer of material being relatively more resilient thatn the other layer of material, and wherein said inner layer of material completely and seamlessly surrounds and is in contact with said light source and wherein said outer layer of material completely surrounds and is in contact with said inner layer of material, said inner layer of material adhering to said light source for maximum attenuation of induced oscillations resulting from said shock forces.

2. A lamp according to claim 1 characterized by the fact that said one layer of material comprises silicone rubber.

3. A lamp according to claim 1 characterized by the fact that the outer surface of said translucent region of said casing is provided with a pattern for affecting the light emission characteristic of said lamp.

4. A lamp according to claim 1 characterized by the fact that said inner layer is said one layer and said outer layer is said other layer of said casing and said outer layer consists of a sterilizable plastic, such as a polycarbonate, especially polytetrafluoraethylene.

5. A lamp according to claim 1 characterized by the fact that said inner layer is said one layer and said other layer comprises plastic material reinforced with glass fibers, such as polycarbonate, polyepoxy-resins, polyester-resins, acrylate.

6. A lamp according to claim 5 characterized by the fact that said inner layer is said one layer and said other layer is reinforced with pre-stressed glass fiber strands.

7. A lamp according to claim 1 characterized by the fact that said light source is self-illuminating and independent of reflecting outside light.

8. A lamp according to claim 7 characterized by the fact that said light source is chosen from a group comprising glow lights, filament lights, gas discharge tubes, light diodes and ultraviolet lamps with fluorescent coloring.

9. A lamp according to claim 1 characterized by the fact that said layers have differing densities and differing elasticity modules.

10. An electrically insulated impact-resistant fluid-tight sealed self-cooling explosion proof electric lamp comprising:

an electric light source including a glass envelope; and a multilayered casing completely enveloping said light source, said multilayered casing at least comprising:

an outermost housing translucent on at least one side and fabricated of a relatively rigid material, and a layer of relatively resilient transparent material within said housing in contact with said glass envelope and within which said light source is entirely and seamlessly embedded, said layer of relatively resilient transparent material adhering to said glass envelope for maximum attenuation of induced oscillations resulting from impacts imposed on said lamp.

11. A lamp according to claim 10 wherein said housing is fabricated of rigid material having an opening on one side and further including transparent rigid material disposed between said housing and said layer of relatively resilient material.

12. A lamp according to claim 11 wherein said housing is fabricated of PVC.

13. A lamp according to claim 11 wherein said housing is metal.

14. A lamp according to claim 13 characterized by the fact that said casing contains plastics reinforced with glass fibers selected from a group comprising polycarbonate, polyepoxy-resins, polyester-resins, and acrylate fibers.

15. A lamp according to claim 14 characterized by the fact that said casing is reinforced with pre-stressed glass fibers.

16. A lamp according to claim 10 characterized by the fact that said light source is self-illuminating and independent of reflecting outside light.

17. A lamp according to claim 16 characterized by the fact that said light source is selected from a group comprising glow lights, filament lights, gas discharge tubes, light diodes, and ultraviolet lamps with fluorescent coloring.

18. A lamp according to claim 17 characterized by the fact that an increase of light emission is achieved by providing the surface of said transparent rigid material with integrally formed lenses.

* * * * *